United States Patent [19]

Lambertz

[11] Patent Number: 4,740,217

[45] Date of Patent: Apr. 26, 1988

[54] GASIFICATION PROCESS USING FLUIDIZED BED REACTOR WITH CONCENTRIC INLETS

[75] Inventor: Johannes Lambertz, Kerpen, Fed. Rep. of Germany

[73] Assignee: Rheinische Braunkohlenwerke AG, Cologne, Fed. Rep. of Germany

[21] Appl. No.: 862,280

[22] Filed: May 12, 1986

Related U.S. Application Data

[62] Division of Ser. No. 666,425, Oct. 30, 1984, abandoned.

[30] Foreign Application Priority Data

Nov. 5, 1983 [DE] Fed. Rep. of Germany ..... 3340085

[51] Int. Cl.[4] ..... C10J 3/54

[52] U.S. Cl. ..... 48/197 R; 48/206

[58] Field of Search ..... 48/63 R, 63, 77, 206, 48/DIG. 4, 197 R

[56] References Cited

U.S. PATENT DOCUMENTS 2,343,958 3/1944 Crowe ..... 239/549
4,391,611 7/1983 Haldipur et al. ..... 48/197 R

FOREIGN PATENT DOCUMENTS 3143556 3/1981 Fed. Rep. of Germany .
51383 5/1974 German Democratic Rep. .
59-142285 8/1984 Japan ..... 63/
7809967 3/1979 Netherlands ..... 48/206

OTHER PUBLICATIONS

Freiberger Forschungshefte, pp. 10 and 11, Botho von Portatius "Neuere Entwicklung der Vergasungstechnik nach Winkler".

*Primary Examiner*—Peter Kratz
*Assistant Examiner*—3340085
*Attorney, Agent, or Firm*—Howson and Howson

[57] ABSTRACT

In a process for the gasification of carbonaceous substances, exothermic and endothermic gasification agents are injected into the reaction area through at least one nozzle comprising at least two coaxial pipes, the outer pipe terminating short of the end of the inner pipe, at a distance such that the end face of the outer pipe is in a region of the pressurized interior of the reactor, in which the temperature is below the melting point of the ash of the solid particles to be gasified. The speed of flow of the endothermic agent out of the annular gap between the pipes is substantially higher than the speed of flow of the exothermic agent out of the inner pipe and the flow of endothermic gasification agent tends to be constricted around the flow from the inner pipe. The outer edge of the inner pipe is a sharp, right-angled edge so that in the region thereof eddies are formed which protect the region from the penetration of particles of ash therein.

3 Claims, 2 Drawing Sheets

GASIFICATION PROCESS USING FLUIDIZED BED REACTOR WITH CONCENTRIC INLETS

CROSS REFERENCE TO RELATED APPLICATION

This is a division of my copending application Ser. No. 666,425, filed Oct. 30, 1984 now abandoned.

BACKGROUND OF THE INVENTION

The present invention relates generally to a process for the gasification of carbonaceous solids and a fluidised bed reactor for carrying out such a process.

A known form of fluidised bed reactor for the gasification of carbonaceous solids comprises at least one nozzle for the injection of exothermic and endothermic gasification agents into the interior of the reactor. The nozzle is provided with at least two mutually coaxially disposed pipes which thus define at least one annular opening. The outer pipe, which is provided for supplying at least predominantly endothermic gasification agent, is thus disposed around the inner pipe which is provided for supplying at least predominantly exothermic gasification agent. The mouth opening or discharge orifice of the inner pipe projects further into the interior of the fluidised bed reactor than the mouth opening or discharge orifice of the outer pipe, while a region of increased temperature is formed in front of the orifice of the inner pipe, within the reactor, due to the reaction of the exothermic gasification agent with combustible substances.

Generally, the reactor has a plurality of such nozzles which are distributed around the periphery thereof, and the nozzles may possibly be arranged at two or more levels which are vertically spaced from each other.

More specifically, a reactor of the aboveindicated nature is disclosed in 'Freiberger Forschungshefte' A69, 1957, pages 10 and 11. The supply of carbon dioxide in the outer pipes of the nozzles is provided to reduce the temperature of the fluidised bed in the region where the oxygen is introduced, that is to say, the discharge orifices, in order in that way to reduce slag deposits. The problem involved in the formation of such slag deposits or baked-on formations is also dealt with in German laid-open application (DE-OS) No. 31 43 556 which discloses a reactor provided with a nozzle which has at least three coaxial pipes. The middle pipe is provided for supplying the carbonaceous materials which are to be gasified. The exothermic gasification agent is supplied through the annular space or opening which is defined by the inner pipe and the middle pipe, while the predominantly endothermic gasification agent is introduced into the interior of the reactor through the annular opening defined by the middle pipe and the outer pipe. The arrangement in that reactor may be such that the pipe which externally delimits the duct for the exothermic gasification agent may terminate at a spacing in the axial direction, upstream or in front of the other two pipes. The spacing between the free end of the outer pipe and the free end of the other two pipes however is only a few millimeters. The formation of baked-on deposits is intended to be prevented by virtue of the discharge end of the outer pipe for the endothermic gasification agent being reduced in the direction of flow therethrough to a very small wall thickness in order in that way to give a correspondingly small end surface so as to afford the minimum possible area for deposit thereon of the particles of ash which are to be found in the interior of the reactor. In addition, in the aboveindicated German laid-open application, there is a discussion regarding the dependency between the formation of baked-on deposits and the relative speeds at which the agents in the mutually coaxial pipes are injected into the interior of the reactor. Thus, the flow speed of the endothermic gasification agent is to be from 70 to 85% of the speed at which the exothermic gasification agent flows into the interior of the reactor. The above-described steps are intended to provide regions which have different levels of oxygen concentration, in the area in front of the discharge orifice of the nozzle, in order thereby to reduce the speed at which the solid carbon of the individual particles is reacted, while also seeking to reduce the extent to which sintering of the individual particles occurs.

The extent to which the arrangements disclosed in German laid-open application No. 31 43 556 are such as to provide the desired effect in the reactor described therein can be left in abeyance as there is in any case no possibility of transferring same to a fluidised bed reactor wherein the carbonaceous materials to be gasified are introduced into the interior of the reactor through a particular supply means which is independent of the nozzles for supplying the gasification agent, especially as such nozzles generally do not extend vertically upwardly into the reactor.

In the Winkler reactor which is disclosed in the publication first referred to above, the cooling action which is produced by the supply of carbon dioxide may have been sufficient to achieve the desired aim, as such a reactor was operated under normal pressure. However, modern fluidised bed reactors, more particularly high temperature Winkler reactors, are operated at increased pressures of 10 bars and more. The use of increased pressure serves to increase the rate of through-put, that is to say, the amount of coal which is to be passed through per unit of time. That presupposes a suitable increase in the amount of gasification agent, that is to say also the exothermic gasification agent. As a result, the specific thermal loading in the reactor is increased, which in turn gives rise to a greater danger of ash deposits and baked-on formations occurring. As indicated also in the prior art, such phenomena occur more particularly at the end faces of the nozzle pipes. That is in essence to be attributed to the fact that temperature peaks occur in the interior of the reactor, at a short spacing from the mouth opening of the nozzles which supply exothermic gasification agent, such temperature peaks occurring more particularly in the region in which the oxygen supplied first comes into contact with combustible substances, either solid particles or combustible gases. The heat which radiates from that high-temperature region acts on the end faces of the respectively associated nozzles so that solid particles with a high ash content, which are to be found in the high-temperature region, undergo softening and stick to the nozzle. In that way, deposits may be formed, the dimensions of which are finally of such a magnitude that the reactor has to be taken out of operation.

SUMMARY OF THE INVENTION

An object of the present invention is therefore to provide a process for the gasification of carbonaceous solids in a fluidised bed reactor, wherein the formation of baked-on deposits is eliminated or reduced, even when there is a high level of specific thermal loading within the reactor, thereby to reduce the level of disturbances in operation of the reactor to an acceptable degree.

Another object of the present invention is to provide a process for the gasification of carbonaceous solids in a fluidised bed reactor, which permits enhanced temperature control in critical regions within the reactor where ash deposits are likely to be formed.

A further object of the present invention is to provide a fluidised bed reactor for the gasification of carbonaceous solids including at least one nozzle for injecting exothermic and endothermic gasification agents into the interior of the reactor, wherein the temperature in a critical region within the reactor, in regard to the formation of baked-on ash deposits, is controlled to reduce the level of incidence of such deposits.

Yet a further object of the invention is to provide a fluidised bed reactor for the gasification of carbonaceous solids, including a simple arrangement for at least reducing the amount of baked-on deposits within the reactor, without complicating either the construction of the reactor or the mode of operation of the process therein.

These and other objects are achieved by a process for the gasification of carbonaceous solids in a fluidised bed reactor which comprises at least one nozzle for injecting exothermic and endothermic gasification agents into the interior of the reactor, the nozzle comprising at least two mutually coaxially disposed pipes defining at least one annular opening, the outer pipe supplying at least predominantly endothermic gasification agent and the inner pipe supplying at least predominantly exothermic gasification agent, with the discharge end of the inner pipe projecting further into the reactor than the discharge opening of the outer pipe. By virtue of the reaction of the exothermic gasification agent, the reactor has an increased-temperature area in front of the discharge opening of the inner pipe. The outer pipe terminates at such a spacing from the discharge opening of the inner pipe that the end boundary surface thereof is disposed in a region of the interior of the reactor, which is operated under an increased pressure, in which the temperature is below the melting point of the ash of the carbonaceous solid particles to be gasified, while the speed at which the at least predominantly endothermic gasification agent flows out of the outer pipe is higher than the speed at which the at least predominantly exothermic gasification agent flows out of the inner pipe.

The invention also provides a fluidised bed reactor for carrying out the process as outlined above.

By virtue of the above-described structure and relationship in accordance with the invention as between the speeds at which the two gaseous agents enter the reactor, it is provided that the annular jet of endothermic gasification agent, after passing the free end of the inner pipe, is deflected inwardly, that is to say, towards the jet of exothermic gasification agent which is coming out of the inner pipe. However, because of the high level of kinetic energy of the endothermic gasification agent, the deflection action only takes place at a certain distance from the end face of the inner pipe which supplies the exothermic gasification agent, so that over a certain distance from the end of the pipe, the endothermic gasification agent forms a kind of screen or shield for the exothermic gasification agent, to prevent solid particles which are being swirled around in the area in front of the discharge opening of the nozzle from reaching the end of the inner pipe which supplies the exothermic gasification agent. Although the endothermic gasification agent will have a certain cooling action, even when it is steam, as the temperature thereof is generally below the temperature which is obtained in the region in which the exothermic gasification agent, that is to say oxygen, is reacting with combustible gas and the solid particles, nonetheless it will not be possible to prevent the free end of the inner pipe being at a temperature which is in a range that exceeds the ash melting point of the solid particles to be gasified, by virtue of the radiant heat produced in the region in which the exothermic gasification agent reacts, acting on the free end of the inner pipe. Therefore, as indicated above, a crucial consideration is that the solid particles are to be kept out of the region in the direct vicinity of the free end of the pipe supplying the exothermic gasification agent. That is particularly important for the reason that eddies are formed directly in front of the end surface of the inner pipe, and such eddies, without the arrangement according to the invention, would cause solid particles which had penetrated into that region to remain therein for a prolonged period of time.

The outer pipe is not screened or shielded in an outward direction. It is thus possible for solid particles to go into the region of the free end thereof. In order nonetheless to avoid baked-on deposits being formed thereat, the pipe is shorter than the inner pipe for the exothermic gasification agent, the spacing between the ends of the two pipes being such that the end face of the wall of the outer pipe is in a region which is so far removed from the high-temperature region in front of the discharge opening of the inner pipe that the temperature in the region of the discharge opening of the outer pipe is below the ash fusion temperature, while however the spacing between the ends of the two pipes is sufficiently small that the annular flow of endothermic gasification agent which is discharged through the annular space defined between the inner and outer pipes, after leaving the outer pipe, is maintained as long as is required to perform the above-described function. An aspect which is of major significance in regard to the desired lower temperature at the free end of the outer pipe is that the portion of the inner pipe, which projects relative to the outer pipe, screens or shields the outer pipe from the high-temperature region which is to be found in front of the discharge opening of the inner pipe, so that the heat which is radiated from the high-temperature region, before reaching the outer pipe, is absorbed by the portion of the inner pipe which projects beyond the end of the outer pipe and which in turn is subjected to a certain cooling action by the two gasification agents.

In a preferred embodiment of the reactor of the invention, the end portion of the outer pipe may be bevelled or chamferred on its outside in such a way that the wall thickness of the outer pipe decreases in that portion, in a direction towards the end face of the outer pipe.

The invention further provides, in another preferred aspect, that the inner pipe is provided at its outer peripheral surface, at least in the region which projects beyond the outer pipe, with a refractory and wear-resistant ceramic insert or inlay. That configuration takes account of the fact that the peripheral surface of the inner pipe which projects with respect to the outer pipe is subjected to an increased rate of wear due to the co-operation of the gasification agent which flows therepast and the solid particles which impinge thereon.

Preferably, the axial spacing between the end of the inner pipe and the end of the outer pipe is from about 1.5 to 2.5 times the wall thickness of the inner pipe, being preferably twice that thickness, while the width of the annular opening is not more than 2 mm. In addition, the discharge speed of the endothermic gasification agent, being the speed at which it issues from the annular gap or opening defined between the inner and outer pipes, should be at least 1.1 times the discharge speed of the exothermic gasification agent from the inner pipe. These comparatively simple steps ensure that the injection nozzle operates in a substantially trouble-free and maintenance-free fashion. In that way it is possible for the proportion of oxygen in the central pipe at any ring injection nozzle in question in the high temperature Winkler gasifier to be increased to up to 100%.

The deflection of the flow of endothermic gasification agent which issues from the annular opening defined between the inner and outer pipes, at the edge of the inner pipe, in an inward direction, is further promoted by that edge being of a sharp-edged configuration. The fact that the edge is sharp and defines at least substantially a right angle reliably ensures that the flow from the outer pipe, which flows along the outside peripheral surface of the inner pipe, is deflected towards the longitudinal axis of the injection nozzle, so that in this connection reference may be made to the flow being constricted in the region of the abovementioned edge of the inner pipe.

In accordance with another feature of the invention, it is possible for the outer pipe to be supported on the outer periphery of the inner pipe in such a way that a uniform width in respect of the annular gap between the inner and outer pipes may be ensured, using simple adjusting means. By virtue of that arrangement, the flow through the annular opening, which comprises predominantly endothermic gasification agent, can be precisely adjusted so that it is of at least substantially uniform thickness over the entire periphery of the annular opening.

Further objects, features and advantages of the process and apparatus according to the principles of the present invention will be more clearly apparent from the following description of a preferred embodiment thereof.

DESCRIPTION OF THE PREFERRED EMBODIMENT

Figure 1:
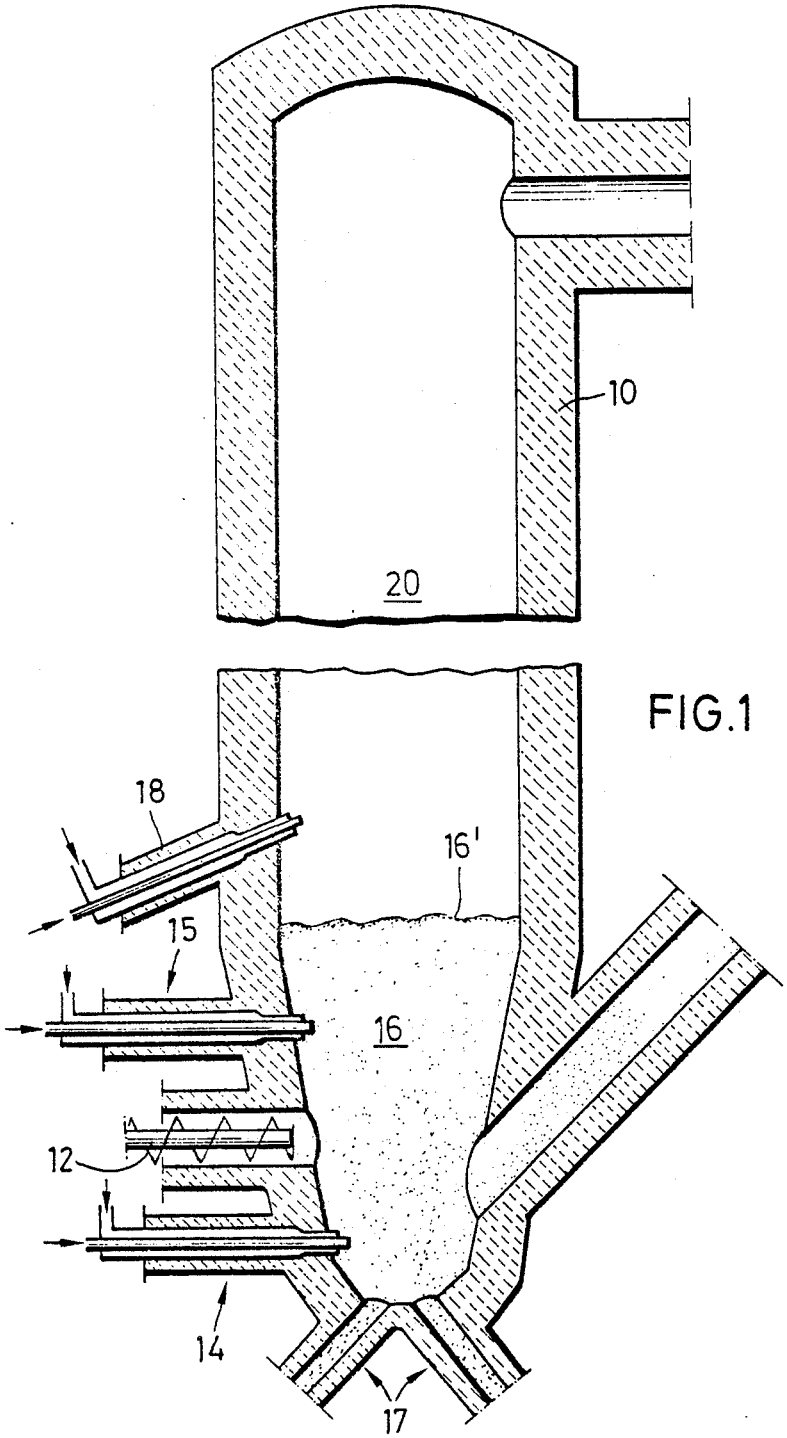
FIG. 1 shows a diagrammatic view in longitudinal section of a high temperature Winkler reactor.

FIG. 1 shows a fluidised bed reactor which can be used for carrying out the process according to this invention. Fuel which is to be gasified and possibly additive substances are introduced into the reactor as indicated generally at 10 in FIG. 1, into the lower region thereof, through a feed screw 12. Under the influence of gasification agents which are injected also into the lower part of the reactor 10 through injection nozzles as indicated at 14 and 15, a fluidised bed 16 is formed in the lower part of the reactor 10, the upper boundary surface of the bed 16 being denoted by reference numeral 16'. Disposed adjacent the lower boundary of the reactor 10, that is to say, substantially beneath the injection nozzle 14, is a layer or stratum of ash-rich, possibly coarser material which is taken off downwardly through the extension portions 17 which form connecting ducts for that purpose.

Further injection nozzles 18 are disposed above the level of the fluidised bed 16. The nozzles 18 introduce gasification agent into the post-reaction chamber 20 above the fluidised bed. In contrast to the diagrammatic representation shown in FIG. 1, the injection nozzles are usually arranged in a distributed array at spacings from each other around the periphery of the reactor. It will be appreciated therefore that the nozzle arrangement shown in FIG. 1 is only in highly diagrammatic form.

At least some of the injection nozzles are of the construction which will be described hereinafter with reference to FIGS. 2 and 3. The nozzle construction illustrated therein permits gasification agents which produce exothermic reactions and endothermic reactions to be simultaneously blown into the reactor.

Figure 2:
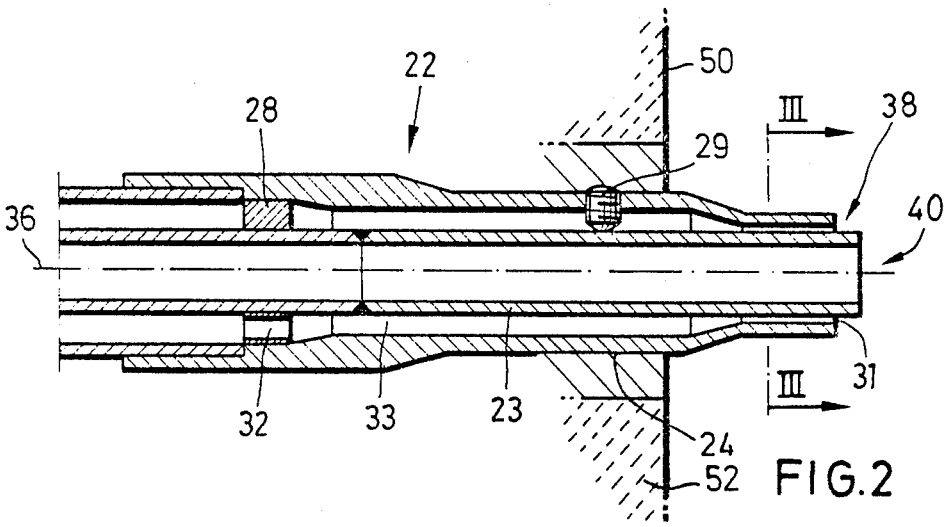
FIG. 2 shows a view in longitudinal section of the nozzle according to the invention.

Referring therefore now to FIG. 2, shown therein is an injection nozzle 22 which may be arranged in a fashion corresponding to the respective nozzles 14, 15 and 18 illustrated in FIG. 1 and which comprises an inner pipe 23 and an outer pipe 24. The two pipes 23 and 24 are at least substantially coaxially disposed and thereby define at least one annular opening therebetween. The inner pipe 23 is operable to inject into the interior of the reactor, the gasification agent as indicated at 25, which produces a substantially exothermic reaction, being for example oxygen or air or a mixture of oxygen and an endothermic gasification agent. It will be seen therefore that the inner pipe injects an at least predominantly exothermic gasification agent. The outer pipe 24 is provided for injecting a gasification agent 26, for example steam, which is substantially endothermic. As indicated above, the outer pipe coaxially surrounds the inner pipe 23 and is supported on the outer peripheral surface thereof, over the length thereof, at two locations as indicated at 28 and 29 in FIG. 2, which are spaced in the axial direction of the nozzle. While the support means 28 essentially comprises a spacer member which fills a large part of the annular cross-section defined between the two pipes 23 and 24, the support means 29 which is disposed in the vicinity of the discharge opening of the nozzle pipe arrangement comprises a plurality of punctiform support means which engage the peripheral surface of the inner pipe 23 at spacings from each other and which are adjustable. The support means may be for example screws or screwthreaded pins which can be precisely adjusted in such a way as to provide a uniform coaxial annular gap 31 between the two pipes 23 and 24. The spacer member 28 has apertures 32 which are distributed around the periphery thereof and through which the endothermic gasification agent 26 can flow, in the annular space 33 between the pipes 23 and 24. The endothermic gasification agent 26 thus issues from the annular gap 31 while the exothermic gasification agent 25 issues from the inner pipe 23. FIG. 3 shows the flow paths of the gasification agents 25 and 26 as they issue from their respective pipes. The end face 27 of the inner pipe 23 projects further into the interior of the fluidised bed reactor, than the end face 37 of the outer pipe 24. The distance as indicated at 38 between the ends of the two pipes 23 and 24 corresponds to a multiple of the wall thickness as indicated at 39 of the inner pipe 23 and is for example from 1.5 to 2.5 times the wall thickness 39, preferably being twice the wall thickness 39.

The exothermic gasification agent 25 issues from the flow cross-section of the discharge opening of the inner pipe 23 at a speed of 15 to 70 meters per second and passes into the interior of the reactor 10, as indicated generally at 40 in FIG. 2 In the region of the fluidised bed 16, that is to say, in respect of the nozzles 14 and 15 in FIG. 1, the speed of discharge of the exothermic agent 25 may be close to the upper limit of the above-indicated speed range, whereas in the region of the post-reaction chamber 20, being therefore in respect of the nozzle 18, the speed will generally not exceed 40 meters per second. In the case of the high temperature Winkler reactor, for example, the exothermic gasification agent is predominantly pure oxygen or a mixture of oxygen and steam or oxygen and nitrogen, the proportion of oxygen usually being about 70 to 80%. The reaction of the combustible gas and the carbonaceous particles of brown coal or lignite with the gasification agent 25 begins in the region 40 around the mouth opening of the pipe assembly, that is to say, at a distance of from a few millimeters to a few centimeters from the inner pipe 23. The flame which is produced during the gasification reaction referred to above is indicated at 46 in FIG. 3. In that area, the temperatures are between 1700° and 1800° C. and are therefore much higher than the average temperature in the gasification chamber where the temperatures are usually 1000° to 1200° C.

The endothermic gasification agent 26, being for example superheated and thus gaseous steam, passes into the reaction chamber from the annular gap 31 which is formed between the two pipes 23 and 24. As can be clearly seen by reference to the flow paths of the gasification agent 26 in FIG. 3, the endothermic agent 26, or steam, surrounds the flow paths of the exothermic gasification agent 25, after it issues from the annular gap 31, and defines a flow configuration around the periphery of the flow of exothermic agent 25. The gasification agent 26 first flows over the axial distance 38 along the outside surface of the inner pipe 23 and is deflected inwardly at the outer edge 34 thereof, thereby causing a constriction in the flow pattern at 26. In that connection, the outer edge 34 of the end face 27 of the inner pipe 23 forms a break-off edge, namely an edge at which the flow along the outside surface of the inner pipe 23 breaks away, that being the causc of the constriction effect in regard to the flow of endothermic gasification agent and the formation of a space within which are formed eddies as indicated at 42 which come both from the flow of gasification agent 26 and from the flow of gasification agent 25. In comparison with the speeds of those two flows, the speed of the eddies 42 is considerably less so that, if solid particles could penetrate into the abovementioned region of the eddies 42, which is at high temperature, it would be inevitable that ash would be deposited and baked on the pipe 23. However, the solid particles are prevented from getting into the region 42 by the outside flow configuration formed by the endothermic gasification agent 26 around the exothermic gasification agent flow 25. Accordingly, the end faces 27 remain free of baked-on deposits.

The flow of the gasification agent 26 is constricted at an angle as indicated at 43 which approximately corresponds to a theoretical envelope over the outer edges 34 and 35 of the pipes 23 and 24. In the region in which the flow of gasification agent 26 is constricted, eddies are formed, as indicated at 45, which cause particles of solid material to pass out of that region through the outside flow 26 into the flow 25 of exothermic gasification agent. The resulting reaction leads to the above-mentioned high temperature in the region of the flame 46.

The radial thickness of the annular gap 31 is between 0.7 and 2 mm and is preferably 1.4 mm, for example when the outside diameter of the inner pipe 23 is 12.6 mm. In addition, the mouth portions of the inner and outer pipes 23 and 24 are produced from a material which is resistant to high temperature, for example Inconel, and those portions may be adjoined at an axial spacing from the ends 27 and 37 of the pipes 23 and 24 respectively, by pipe portions made of another material. Simultaneously with that nozzle configuration, the annular space 33 which is formed between the inner and outer pipes 23 and 24 may vary in regard to its radial extent, as can be seen for example from FIG. 2. In that connection, the support means 29 which is closer to the ends of the inner and outer pipes 23 and 24 may be adjustable.

Preferably, the narrowest cross-section of the abovementioned annular space 33 is disposed in the forward portion of the nozzle assembly, in the vicinity of the region 40 at the mouth openings of the pipes, so that the highest flow speed of the gasification agent 26 occurs at the annular gap or opening 31.

In the embodiment illustrated in the drawing, the end portion of the outer pipe 24 has a bevelled or chamferred section as indicated at 47, whereby the wall thickness of the outer pipe 24 decreases in the end portion thereof in a direction towards the end face thereof. In that way, the end face 37 of the pipe 24, which is to be screened or shielded from the high-temperature region 46, is of only slight radial extent, thereby reducing the possibility of material being deposited and baked thereon.

Figure 3:
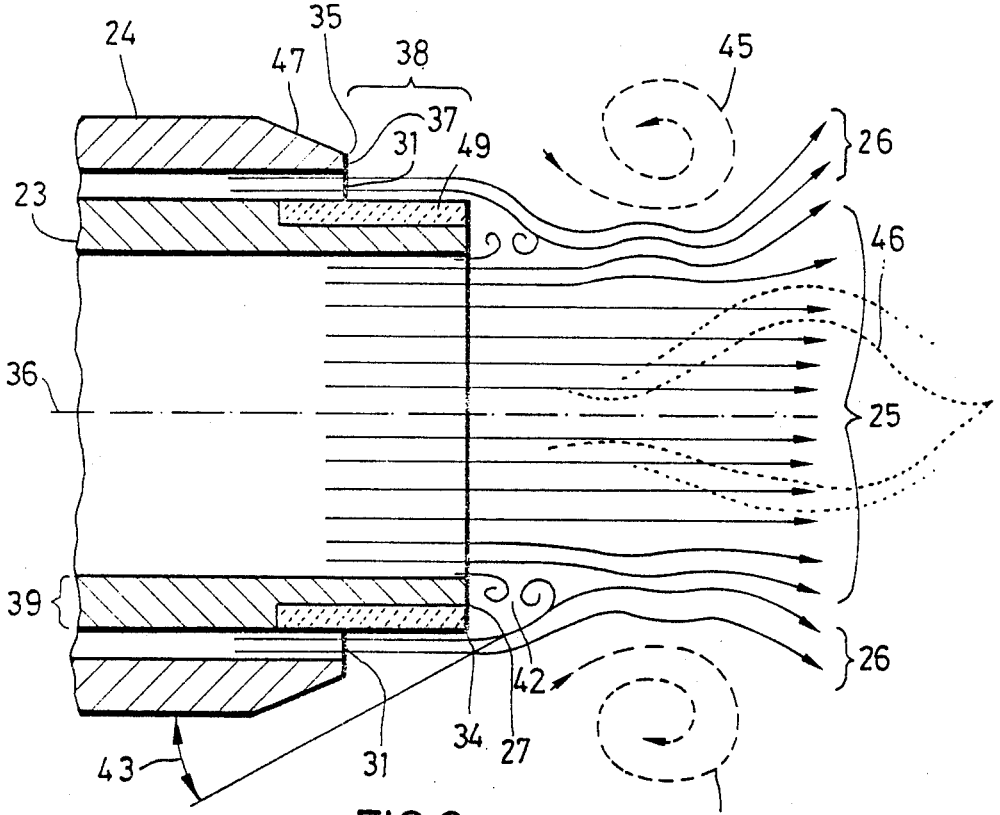
FIG. 3 shows a portion on an enlarged scale of the mouth opening of the nozzle, in the region indicated by line III—III in FIG. 2.

In addition, as can be seen from FIG. 3, the end portion of the inner pipe 23 is provided on the outside peripheral surface thereof with an insert or inlay 49 comprising for example a wear-resistant material, preferably a ceramic material. The inlay 49 is thus provided in the outside surface of the portion of the inner pipe which projects beyond the end of the outer pipe.

It should also be noted from FIG. 2 that the outer pipe 24 also projects into the interior of the reactor, beyond the inside wall surface 50 of the wall 52 of the reactor, so that the inside surface 50 of the wall of the reactor is at any event in a temperature area at which ash cannot be deposited and baked thereon.

It will be seen from the foregoing description of the process and reactor that the phenomenon of deposit and baking of material on the end faces of the nozzle assembly is at least substantially reduced, even at a high level of specific thermal loading within the reactor so as to reduce disturbances and trouble in operation of the assembly, to an acceptable degree. Furthermore, the means by which the deposit and baking-on of material is reduced are simple and do not complicate either the construction of the reactor or the mode of performance of the gasification reaction process therein.

Various modifications and alterations may be made in the above-described process and reactor without thereby departing from the scope of the invention as defined by the appended claims.

What is claimed is:

1. A process for the gasification of carbonaceous solids in a fluidized bd reactor having at least one nozzle for injecting exothermic and endothermic gasification agents into the pressurized interior of the reactor, wherein the nozzle comprises at least first and second mutually coaxially disposed pipes defining an annular opening therebetween, the outer pipe supplying at least predominantly endothermic gasification agent and the inner pipe supplying at least predominantly exothermic gasification agent, and an increased-temperature region being formed in front of the opening of the inner pipe in the interior of the reactor by virtue of the reaction of the exothermic gasification agent issuing therefrom, wherein the outer pipe terminates short of the mouth opening of the inner pipe at such a spacing therefrom that the end face of the outer pipe is in a region in the reactor in which the temperature is below the melting point of the ash of the carbonaceous solid particles to be gasified and the speed of flow of the at least predominantly endothermic gasification agent out of the outer pipe is higher than the speed of flow of the at least predominantly exothermic gasification agent out of the inner pipe wherein all of said carbonaceous solids are introduced into said fluidized bed reactor through inlet means external to and remote from said nozzle.

2. A process as set forth in claim 1 wherein the endothermic gasification agent issues from the outer pipe at a speed which is at least 1.1 times the speed at which the exothermic gasification agent issues from the inner pipe.

3. A process for the gasification of carbonaceous solids using exothermic and endothermic gasification agents wherein the gasification agents and carbonaceous solids are introduced into a pressurized reactor chamber at separate locations, the process comprising:

injecting said exothermic and endothermic gasification agents into the interior of said pressurized chamber through a nozzle comprising inner and outer mutually coaxially disposed pipes having an annular space therebetween and having end faces and mouth openings within the interior of said chamber, the outer pipe terminating short of the mouth opening of the inner pipe at a spacing therefrom such that the end face of the outer pipe is disposed in a region in the chamber in which the temperature is below the melting point of the ash of the carbonaceous solid particles to be gasified, and such that the end face of the outer pipe is screened by the inner pipe from an increased temperature region;

supplying an at least predominantly endothermic gasification agent through said annular space into the chamber;

supplying an at least predominantly exothermic gasification agent through the inner pipe into the chamber whereby in operation of the reactor said increased temperature region is formed in the pressurized interior of the chamber in front of the mouth opening of the inner pipe due to the reaction of the exothermic gasification agent being discharged therefrom; introducing all of the carbonaceous solids into the interior of said pressurized chamber through inlet means external to and remote from said nozzle; and operating the supplying means for the endothermic and exothermic gasification agents to cause the speed of flow of the at least predominantly endothermic gasification agent discharged from the mouth opening of the outer pipe to be higher than the speed of flow of the at least predominantly exothermic gasification agent discharged from the mouth opening of the inner pipe, whereby the stream of endothermic gasification agent, after passing the axial location of the end face of the inner pipe, is deflected inwardly in order to form a screen for the exothermic gasification agent and thus prevents solid particles from reaching the end face of the inner pipe.

* * * * *